US007642999B2

(12) United States Patent
Oura

(10) Patent No.: US 7,642,999 B2
(45) Date of Patent: Jan. 5, 2010

(54) IMAGE PROCESSING CIRCUIT

(75) Inventor: Hisaharu Oura, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 595 days.

(21) Appl. No.: 11/425,586

(22) Filed: Jun. 21, 2006

(65) Prior Publication Data

US 2007/0024563 A1 Feb. 1, 2007

(30) Foreign Application Priority Data

Jul. 27, 2005 (JP) ..... 2005-216749

(51) Int. Cl.
*G09G 3/36* (2006.01)
*G09G 5/10* (2006.01)

(52) U.S. Cl. ..... 345/98; 345/89; 345/101; 345/690

(58) Field of Classification Search ..... 345/55, 345/84, 87, 92
See application file for complete search history.

(56) References Cited

U.S. PATENT DOCUMENTS 6,304,254 B1 * 10/2001 Johnson et al. ..... 345/204
7,345,668 B2 * 3/2008 Iijima ..... 345/101
7,375,723 B2 * 5/2008 Cheon et al. ..... 345/204

FOREIGN PATENT DOCUMENTS

EP 1 507 252 A1 2/2005
EP 1 528 534 A1 5/2005
EP 1 538 595 A1 6/2005
JP 2004-133159 4/2004

* cited by examiner

*Primary Examiner*—Sumati Lefkowitz
*Assistant Examiner*—Charles Hicks
(74) *Attorney, Agent, or Firm*—Oblon, Spivak, McClelland, Maier & Neustadt, L.L.P.

(57) ABSTRACT

The present invention provides an image processing circuit capable of sufficiently correcting a temperature characteristic of a response speed, varying depending on gray-scale, of a liquid crystal display, while suppressing an increase in circuit scale. The present invention provides an image processing circuit for a liquid crystal display performing overdrive processing and the image processing circuit includes a overdrive LUT 1 for outputting an overdrive calculation value, based on image data of a previous frame and image data of a current frame, a plurality of temperature correction LUTs 2 each outputting a correction value for use in temperature correction of the overdrive calculation value, a temperature correction LUT selection circuit 3 for selecting one of the temperature correction LUTs 2 based on temperature data, and a correction calculation circuit 4 for calculating an overdrive output value based on the overdrive calculation value output from the overdrive LUT 1 and the correction value output from the temperature correction LUT 2 selected by the selection circuit 3.

6 Claims, 5 Drawing Sheets

FIG. 1 PRIOR ART
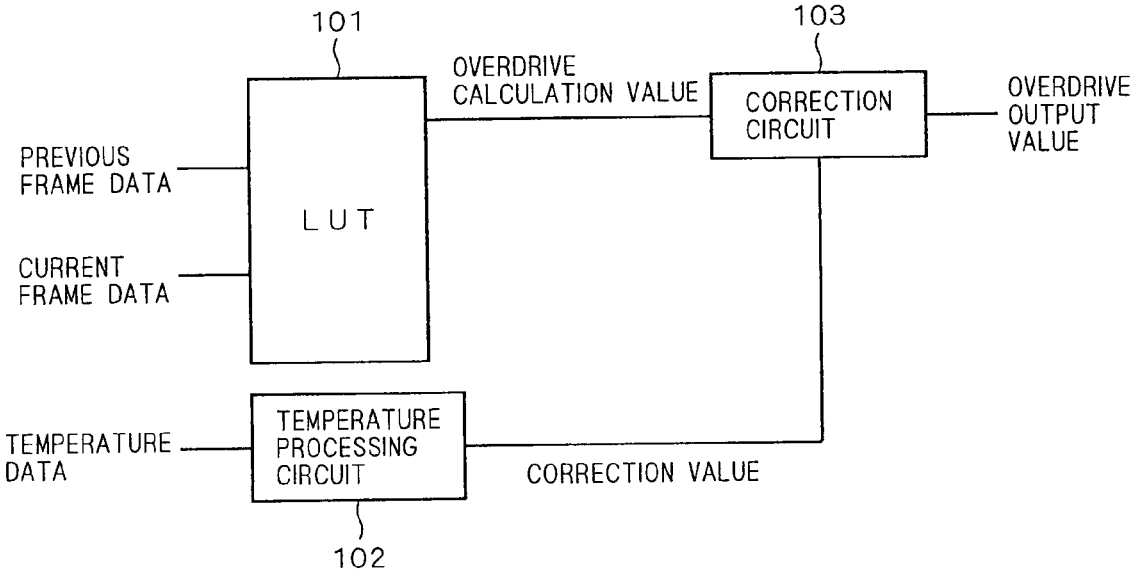
FIG. 2 PRIOR ART
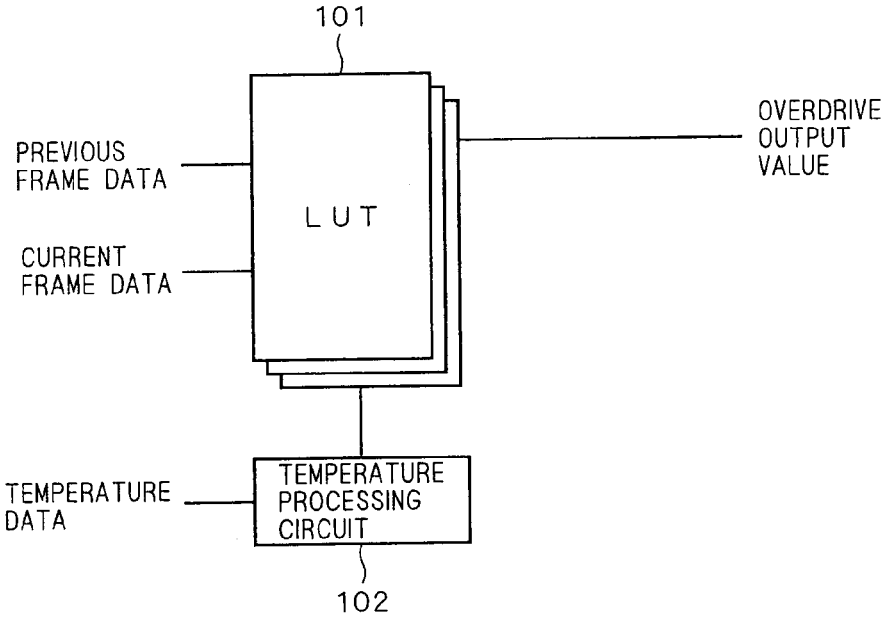

FIG. 4

| THRESHOLD VALUE | | 8 | 16 | 24 | 32 | 40 | 48 | 56 |
|---|---|---|---|---|---|---|---|---|
| IMAGE DATA OF PREVIOUS FRAME OR CURRENT FRAME | 0~7 | 8~15 | 16~23 | 24~31 | 32~39 | 40~47 | 48~55 | 56~63 |
| PREVIOUS FRAME DATA OR CURRENT FRAME DATA | 000 | 001 | 010 | 011 | 100 | 101 | 110 | 111 |

F I G . 5

CURRENT FRAME DATA

PREVIOUS FRAME DATA

| | 0 | 1 | 2 | 3 | 4 | 5 | 6 | 7 |
|---|---|---|---|---|---|---|---|---|
| 0 | | | | | | | | |
| 1 | | | | | | | | |
| 2 | | | | | | | | |
| 3 | | | | | | | | |
| 4 | | | | | | | | |
| 5 | | | | | | | | |
| 6 | | | | | | | | |
| 7 | | | | | | | | |

F I G . 6

CURRENT FRAME DATA

PREVIOUS FRAME DATA

| | | 0 | 1 | 2 | 3 | 4 | 5 | 6 | 7 |
|---|---|---|---|---|---|---|---|---|---|
| | | 0 | | | | 1 | | | |
| 0 | 0 | | | | | | | | |
| 1 | | | | | | | | | |
| 2 | | | | | | | | | |
| 3 | | | | | | | | | |
| 4 | 1 | | | | | | | | |
| 5 | | | | | | | | | |
| 6 | | | | | | | | | |
| 7 | | | | | | | | | |

IMAGE PROCESSING CIRCUIT

BACKGROUND OF THE INVENTION

1. Field of the Invention

The present invention relates to an image processing circuit and, more particularly, to an image processing circuit for use in a liquid crystal display.

2. Description of the Background Art

In recent years, liquid crystal displays have been utilized in various fields and have been utilized in televisions as well as in PC monitors. However, liquid crystal displays have low response speeds, thereby including the problem of degradation of display quality due to afterimages in cases where moving images are mainly displayed thereon as in TV applications. Therefore, overdrive processing methods have been applied to liquid crystal displays, in order to increase their response speeds. Overdrive processing is a processing method for, in cases where image data is moving images, setting a voltage applied to a liquid crystal to be higher than usual if a direction of data change from a previous frame to a current frame is positive, but setting the voltage to be lower than usual if the direction of data change from the previous frame to the current frame is negative. This method can improve display quality of moving images.

As overdrive processing commonly applied to liquid crystal displays, there is a method for calculating an amount of overdrive using a lookup table (hereinafter, simply referred to as "LUT"). However, this method requires an LUT provided in accordance with the number of gray-scale of image data, which has induced the problem of increases of data due to great numbers of gray-scale. For example, in cases of image data of 6 bits (64 gray-scale), there is need for providing an LUT storing 4096 pieces of data for the combinations of 64 gray-scale of a current frame and 64 gray-scale of a previous frame.

Consequently, image data has been quantized with predetermined threshold values and an LUT has been applied to such quantized data to reduce the amount of data in the LUT. More specifically, image data of 64 gray-scale is divided into 8 sections and converted into 3-bit quantized data, by quantizing it with seven threshold values.

Further, it is known that the response speeds of liquid crystal displays depend on the temperature. Namely, the response speed of a liquid crystal display increases with increasing temperature, while the response speed of the liquid crystal display decreases with decreasing temperature. Accordingly, there has been caused the problem that proper overdrive processing can not be performed when an LUT which has been optimally set in a room temperature condition is used at higher temperatures (for example, +60° C.) and lower temperatures (for example, −20° C.).

Consequently, conventional overdrive processing has employed, as methods for correction with respect to temperature changes, a method of correcting output values from LUTs through calculations and a method of providing LUTs in association with respective temperatures as described in Japanese Patent Application Laid-Open No. 2004-133159.

However, the method of correcting output values from LUTs through calculations corrects all gray-scale with the same ratio. Consequently, the method has had the problem of insufficient correction of the temperature characteristic of the response speed of a liquid crystal display which varies depending on the gray-scale.

Further, the method of providing LUTs for respective temperatures has had the problem of increases of the size of an SRAM or the like for storing the LUTs and, therefore, increases of the circuit scale.

SUMMARY OF THE INVENTION

It is an object of the present invention to provide an image processing circuit capable of sufficiently correcting a temperature characteristic of a response speed, varying depending on gray-scale, of a liquid crystal display, while suppressing an increase in circuit scale.

An image processing circuit according to the present invention is used for a liquid crystal display performing overdrive processing, and includes a first lookup table, a plurality of second lookup tables, a selector and a correction calculator. The first lookup table outputs an overdrive calculation value based on image data of a previous frame and image data of a current frame. Each of the plurality of second lookup tables outputs a correction value for use in temperature correction of the overdrive calculation value. The selector selects one of the second lookup tables based on temperature data. The correction calculator calculates an overdrive output value based on the overdrive calculation value output from the first lookup table and the correction value output from the second lookup table selected by the selector.

The image processing circuit according to the present invention includes a plurality of second lookup tables each outputting a correction value for use in temperature correction of an overdrive calculation value, and selects one of the second lookup tables based on temperature data, thereby exhibiting an effect of sufficiently correcting a temperature characteristic of a response speed, varying depending on gray-scale, of a liquid crystal display, while suppressing an increase in circuit scale.

These and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a block diagram for describing a conventional image processing circuit;

FIG. 2 is a block diagram for describing a conventional image processing circuit;

FIG. 4 is a view for describing quantization of image data in the image processing circuit according to the embodiment of the present invention;

FIG. 5 is a view for describing an overdrive LUT in the image processing circuit according to the embodiment of the present invention;

FIG. 6 is a view for describing a temperature correction LUT in the image processing circuit according to the embodiment of the present invention.

DESCRIPTION OF THE PREFERRED EMBODIMENTS

Embodiments

FIG. 1 and FIG. 2 are block diagrams of image processing circuits for describing temperature correction for commonly-performed overdrive processing. The image processing circuit illustrated in FIG. 1 is a method for correcting output values from a lookup table (hereinafter, simply referred to as "LUT") through calculations. First, based on previous frame data and current frame data input to the LUT 101, the LUT 101 outputs an overdrive calculation value. The previous frame data is quantized image data of the previous frame while the current frame data is quantized image data of the current frame. On the other hand, a temperature processing circuit 102 to which temperature data is input determines a correction value based on the temperature data and outputs the determined correction value.

A correction circuit 103, to which the overdrive calculation value and the correction value are input, outputs an overdrive output value resulted from calculations. The calculation performed in the correction circuit 103 is, for example, a method of multiplying the overdrive calculation value by the correction value, by using the correction value as a factor. Consequently, the image processing circuit illustrated in FIG. 1 has the problem of insufficient correction of the temperature characteristic of the response speed of the liquid crystal display which varies depending on the gray-scale.

On the other hand, the image processing circuit illustrated in FIG. 2 is a method of providing LUTs for respective temperatures. First, a temperature processing circuit 102, to which temperature data is input, outputs signals for use in selecting an LUT 101 associated with the temperature data. There are provided LUTs 101 in association with respective predetermined temperature ranges and, based on the signals from the temperature processing circuit 102, an optimal LUT 101 is selected therefrom. The previous frame data and the current frame data are input to the selected LUT 101 and, based on these data, the selected LUT 101 outputs an overdrive output value. For example, if it is assumed that the temperature range of the liquid crystal display is from −40° C. to +85° C. and this temperature range is divided into sections at intervals of about 40° C., three LUTs 101 are prepared. Accordingly, the image processing circuit illustrated in FIG. 2 has the problem of increases of the size of a SRAM for storing the LUTs 101 and, therefore, significant increases of the circuit scale.

Figure 3:
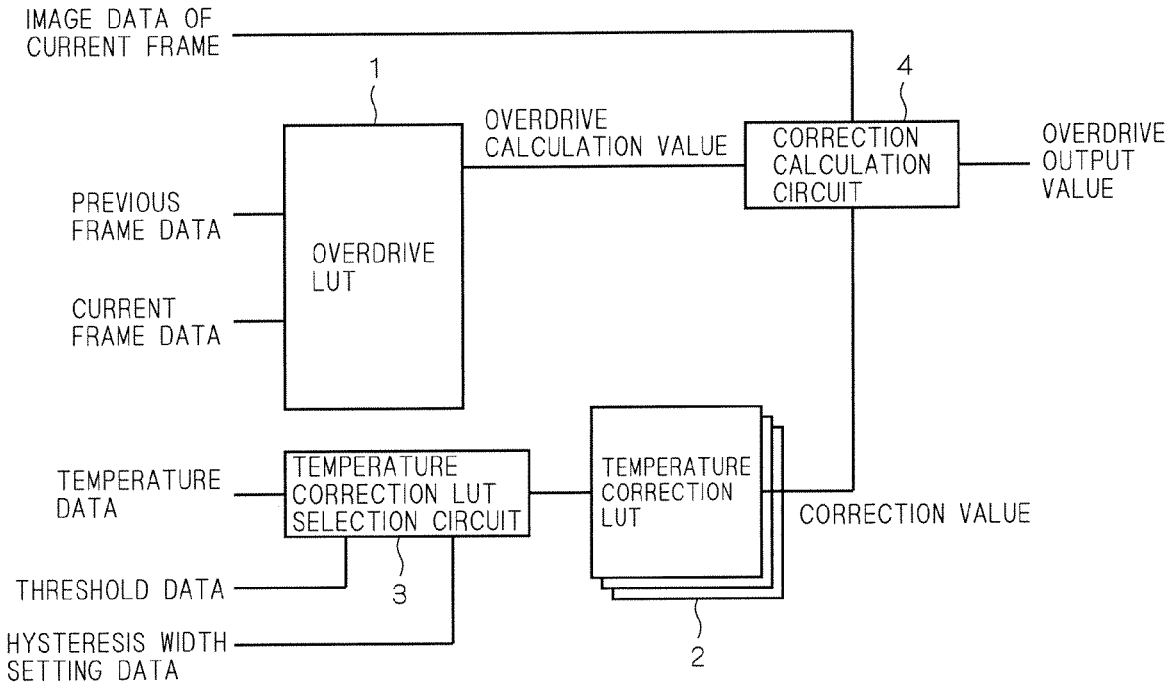
FIG. 3 is a block diagram of an image processing circuit according to an embodiment of the present invention.

FIG. 3 illustrates a block diagram of an image processing circuit according to the present embodiment which is capable of overcoming the aforementioned problems. The image processing circuit illustrated in FIG. 3 is provided with an overdrive LUT 1. To the overdrive LUT 1, previous frame data which is quantized image data of the previous frame and current frame data which is quantized image data of the current frame are input. Hereinafter, a method for quantizing the previous frame data and the current frame data will be described. FIG. 4 illustrates a concrete example of a method for quantizing previous frame data and current frame data. FIG. 4 illustrates quantization of 6-bit (64 gray-scale) image data of the previous frame or the current frame into 3-bit previous frame data or 3-bit current frame data with seven threshold values (a 8-th gray-scale, a 16-th gray-scale, a 24-th gray-scale, a 32-th gray-scale, a 40-th gray-scale, a 48-th gray-scale and a 56-th gray-scale). For example, the image data of the previous frame or the current frame within the range of 0-th to 7th gray-scale is expressed as previous frame data or current frame data of "000" (binary value).

Next, the overdrive LUT 1 outputs an overdrive calculation value, based on the previous frame data and the current frame data. The method for determining an overdrive calculation value will be described, with reference to an overdrive LUT 1 of 3 bits×3 bits illustrated in FIG. 5. In the overdrive LUT 1 illustrated in FIG. 5, the previous frame data is designated in the vertical direction while the current frame data is designated in the horizontal direction. For example, if the previous frame data is "000" (binary value)=0 (decimal value) and the current frame data is "010" (binary value)=2 (decimal value), the data stored in the cell at the intersection of "0" (decimal value) in the vertical direction and "2" (decimal value) in the horizontal direction in the overdrive LUT 1 illustrated in FIG. 5 is determined as the overdrive calculation value.

Also, the overdrive LUT 1 illustrated in FIG. 5 may store, in the respective cells thereof, either differences from data to be usually applied to the liquid crystal or data to be applied to the liquid crystal after overdrive processing. Further, overdrive processing is applied only when the image data of the current frame is a moving image and, therefore, there is provided a moving-image/static-image determination circuit, although not illustrated in FIG. 3.

In the image processing circuit according to the present embodiment, there are provided plural temperature correction LUTs 2 as illustrated in FIG. 3. These temperature correction LUTs 2 are, for example, temperature correction LUTs 2 of 1 bit×1 bit as illustrated in FIG. 6. In the temperature correction LUT 2 illustrated in FIG. 6, previous data of 0 to 3 is defined as "0" and previous data of 4 to 7 is defined as "1" while current data of 0 to 3 is defined as "0" and current frame data of 4 to 7 is defined as "1", and four correction values for their respective combinations are stored therein. The temperature correction LUT 2 enables correcting the temperature characteristic of the response speed of the liquid crystal display which varies depending on the gray-scale.

Further, if it is assumed that the temperature range of the liquid crystal display is from −40° C. to +85° C. and this temperature range is divided into sections at intervals of about 40° C., it is necessary to prepare three temperature correction LUTs 102. In the present embodiment, in order to select an optimal one of these three temperature correction LUTs 2, there is provided a temperature correction LUT selection circuit 3 as a selector.

Temperature data from a temperature sensor (not illustrated), such as a thermocouple, is input to the temperature correction LUT selection circuit 3 illustrated in FIG. 3. Then, the temperature data is quantized based on predetermined threshold data. On the basis of the quantized temperature data, the temperature correction LUT selection circuit 3 selects an optimal one of the plural temperature correction LUTs 2. Further, the threshold data can be arbitrarily set and can be optimized according to the application and the use environment of the liquid crystal display.

More specifically, if the temperature range is divided into sections at intervals of about 40° C. as previously described, three temperature correction LUTs 2 are prepared for the range of −40 to 0° C., the range of 0 to +40° C. and the range of +40 to +85° C. Therefore, it is only required that temperature data is quantized into three values, utilizing threshold data of 0° C. and +40° C. Namely, in quantizing temperature data, temperature data in the range of −40 to 0° C. is quantized into "00" (binary value), temperature data in the range of 0 to +40° C. is quantized into "01" (binary value), and temperature data in the range of +40 to +85° C. is quantized into "10" (binary value). Consequently, for example, when the temperature data is −20° C., the temperature data is quantized into "00", and the temperature correction LUT 2 for the range of −40 to 0° C., which has been preset in association with the quantized temperature data, is selected.

Further, the temperature correction LUT selection circuit 3 illustrated in FIG. 3 is supplied with hysteresis width setting data. This is for setting a hysteresis width with respect to the change of the temperature data, in order to overcome the problem of display fluctuation in the liquid crystal display (a phenomenon like chattering in the circuit), due to the change of the selected temperature correction LUT 2 along with the change of the temperature data near threshold values. Namely, when the temperature data varies near the threshold values, there is provided a hysteresis characteristic with respect to the change of the temperature data.

Figure 7:
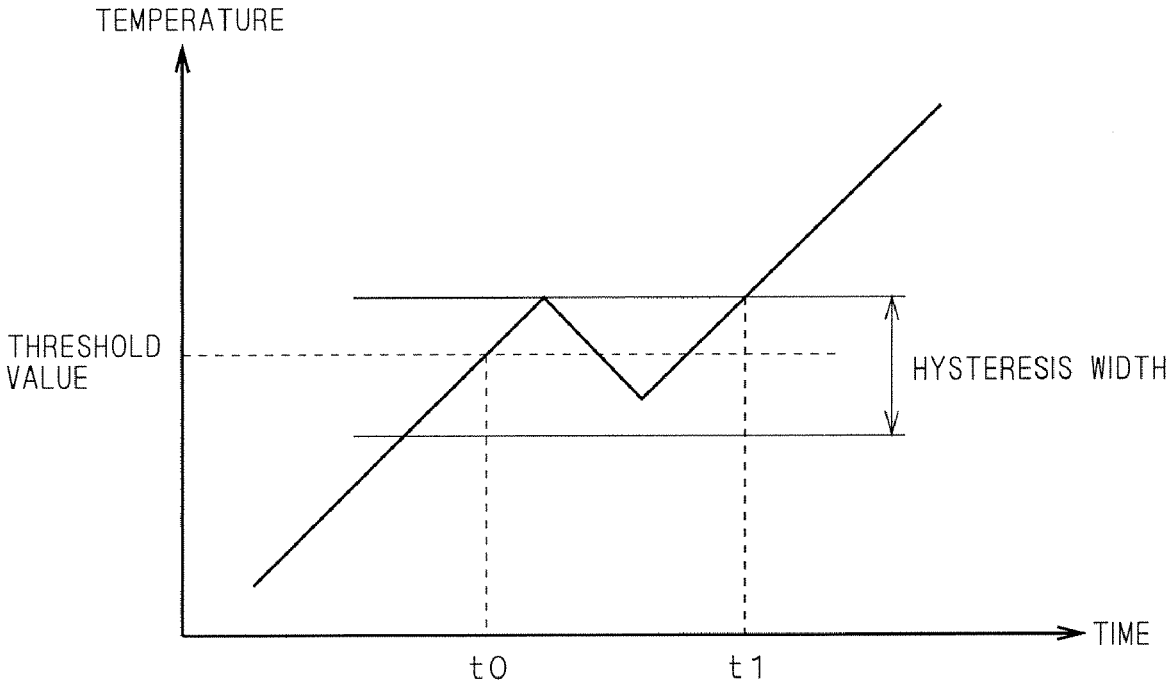
FIG. 7 is a view for describing a hysteresis characteristic of a temperature correction LUT selection circuit according to the embodiment of the present invention.

This will be described in more detail with reference to FIG. 7. First, at time t0, the temperature data exceeds a threshold value and, thus, the original quantized value is updated (for example, "00" is changed to "01"). However, in FIG. 7, there is set a hysteresis width near the threshold value and, consequently, the quantized value is not updated with respect to temperature changes within the width. Consequently, in the example of FIG. 7, the quantized value is not updated until time t1. Accordingly, the image processing circuit according to the present embodiment can prevent the problem of display fluctuation in the liquid crystal display, when the temperature data varies near threshold values. Further, the hysteresis width can be arbitrarily set and can be optimized according to the application and the use environment of the liquid crystal display.

Further, in the image processing circuit illustrated in FIG. 3, there is provided a correction calculation circuit 4 which is a correction calculator for calculating an overdrive output value, based on the overdrive calculation value from the overdrive LUT 1 and the correction value from the temperature correction LUT 2. Further, the overdrive output value is the finally-determined data which is to be applied to the liquid crystal.

For example, the correction calculation circuit 4 performs a calculation of multiplying the overdrive calculation value by a multiplication factor which is the correction value, to determine an overdrive output value, in the case where the overdrive calculation value is a difference from data to be usually applied to the liquid crystal. More specifically, when the overdrive calculation value is +3 and the correction value is 2, the image data of the current frame is added to (+3×2=+6) to determine an overdrive output value. The correction value may be a to-be-added value and, in this case, the value of (+3+2=+5) plus the image data of the current frame is used as an overdrive output value. Also, when the overdrive calculation value is data to be applied to the liquid crystal, it is possible to perform the same processing as that described above by determining the difference. Further, the correction values stored in the temperature correction LUT 2 are determined depending on the form of the overdrive calculation values stored in the overdrive LUT 1 and the structure of the correction calculation circuit 4.

The image processing circuit according to the present embodiment employs temperature correction LUTs 2 having a memory size smaller than that of the overdrive LUT 1. Accordingly, the image processing circuit according to the present embodiment can reduce the size of the SRAM or the like, thereby preventing increases of the circuit scale.

More specifically, if there are provided three overdrive LUTs 1 of 3 bits×3 bits in association with temperature ranges, there is a need for storing a total of 192 (8×8×3) pieces of data. On the other hand, when there are provided a single overdrive LUT 1 of 3 bits×3 bits and three temperature correction LUTs 2 of 1 bit×1 bit in association with temperature ranges, there is a need for storing only a total of 76 ((8×8)+(2×2×3)) pieces of data. Accordingly, the image processing circuit according to the present embodiment can reduce the size of the SRAM or the like.

Further, in the image processing circuit according to the present embodiment, the quantized image data of the previous frame and the current frame is input to the overdrive LUT 1, in order to reduce the memory size of the overdrive LUT 1 as previously described. Accordingly, the image processing circuit according to the present invention is not limited to the case where the quantized image data of the previous frame and the current frame is input thereto and the image data of the previous frame and the current frame may be directly input thereto.

Also, the image processing circuit according to the present embodiment may be formed from either hardware or software.

While the invention has been shown and described in detail, the foregoing description is in all aspects illustrative and not restrictive. It is therefore understood that numerous modifications and variations can be devised without departing from the scope of the invention.

What is claimed is:

1. An image processing circuit for a liquid crystal display performing overdrive processing, the image processing circuit comprising:

a first lookup table configured to output an overdrive calculation value based on image data of a previous frame and image data of a current frame;

a plurality of second lookup tables each configured to output a correction value for use in temperature correction of said overdrive calculation value output by the first lookup table;

a selector configured to select one of said second lookup tables based on temperature data; and a correction calculator configured to calculate an overdrive output value based on said overdrive calculation value output from said first lookup table and said correction value output from the one of said second lookup tables selected by said selector.

2. The image processing circuit according to claim 1, wherein said second lookup tables each have a memory size smaller than that of said first lookup table.

3. The image processing circuit according to claim 1, wherein said selector quantizes said temperature data based on predetermined threshold data and, based on said quantized temperature data, selects one of said second lookup tables.

4. The image processing circuit according to claim 2, wherein said selector quantizes said temperature data based on predetermined threshold data and, based on said quantized temperature data, selects one of said second lookup tables.

5. The image processing circuit according to claim 3, wherein said selector provides a hysteresis characteristic with respect to a change in temperature data, when said temperature data varies near said threshold data.

6. The image processing circuit according to claim 4, wherein said selector provides a hysteresis characteristic with respect to a change in said temperature data, when said temperature data varies near said threshold data.

* * * * *